US006505751B1

(12) United States Patent
Haas

(10) Patent No.: US 6,505,751 B1
(45) Date of Patent: Jan. 14, 2003

(54) CONVERTIBLE RECYCLING AND REFUSE CONTAINER

(76) Inventor: Philip C. Haas, R.D. #2, Box 159, Kempton, PA (US) 18529

( * ) Notice: Subject to any disclaimer, the term of this patent is extended or adjusted under 35 U.S.C. 154(b) by 0 days.

(21) Appl. No.: 09/519,316

(22) Filed: Mar. 6, 2000

(51) Int. Cl.[7] ..... B65F 1/16; B65D 41/06

(52) U.S. Cl. ..... 220/4.11; 220/293; 220/900.3

(58) Field of Search ..... 220/4.11, 4.04, 220/4.09, 288, 293, 298, 301, 787, 622, 908, 908.3, 909

(56) References Cited

U.S. PATENT DOCUMENTS 366,342 A * 7/1887 Mortenson ..... 220/908
459,942 A * 9/1891 Chubbuck ..... 220/908
3,904,070 A * 9/1975 Lisciani et al. ..... 220/908
4,416,197 A * 11/1983 Kehl ..... 220/908
5,119,960 A * 6/1992 Robbins, III ..... 220/908
5,605,244 A * 2/1997 Bradshaw ..... 220/298
5,624,050 A * 4/1997 Haas ..... 220/4.11
5,634,566 A * 6/1997 Jansen et al. ..... 220/908

* cited by examiner

*Primary Examiner*—Nathan J. Newhouse
(74) *Attorney, Agent, or Firm*—Charles A. Wilkinson; Clinton H. Wilkinson

(57) ABSTRACT

A slatted recycling and refuse receptacle is provided with detents at the top for the mounting of a demountable top on the receptacle. Various tops can be mounted with various decorative treatments. Having the decoration on the top itself enables such decoration to be removed with the top so it doesn't interfere with removal of trash and recyclables from the receptacle through the top.

7 Claims, 3 Drawing Sheets

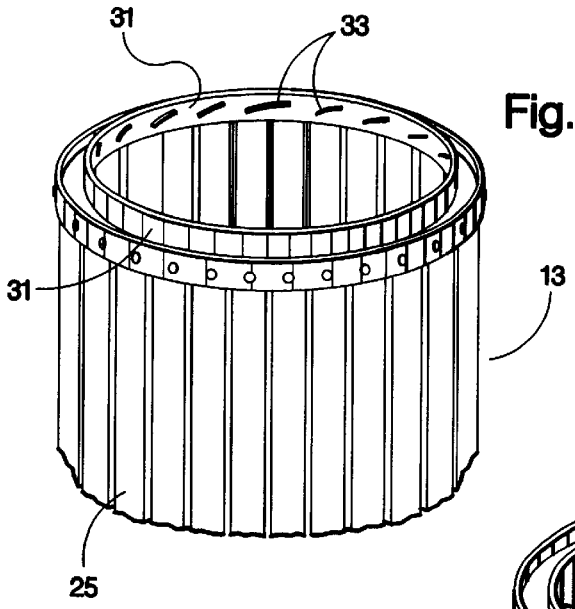
Fig. 11
Fig. 14
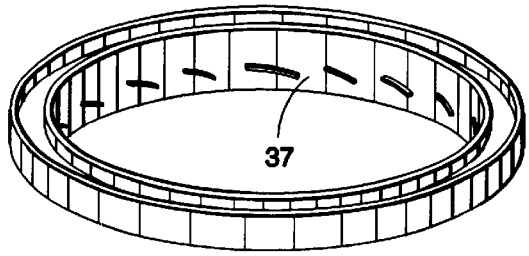
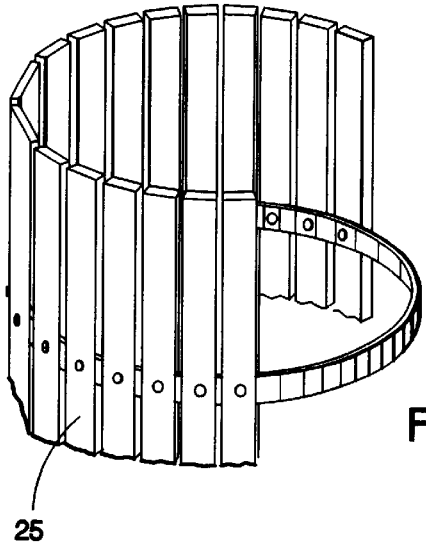
Fig. 12
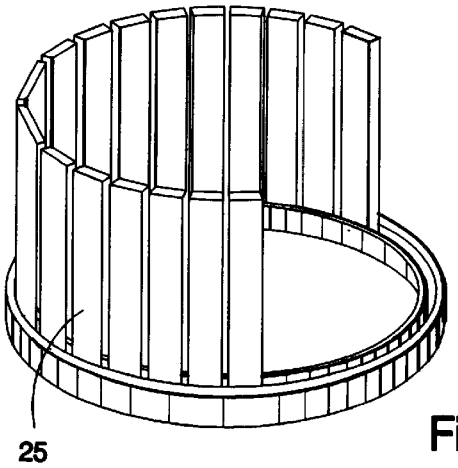
Fig. 13

CONVERTIBLE RECYCLING AND REFUSE CONTAINER

BACKGROUND OF THE INVENTION (1) Field of the Invention

This invention relates broadly to the collection of recyclables and refuse and more particularly to the provision of sturdy, practical yet attractive containers or receptacles for collecting recyclables and refuse. More particularly still, this invention relates to the provision of a convertible trash container suitable for use in various environments and wherein the top section of said container or receptacle is readily converted from one form or configuration to another.

(2) Description of the Prior Art

During the last two or three decades the public collection of recyclables such as cans of various compositions, glass bottles, plastics, paper products and other nominal waste materials and particularly waste packaging materials which can be recycled has come more and more to the fore. Public bodies such as municipalities, state and federal parks and other public bodies as well as corporate entities such as large companies and the like have undertaken to provide recycling and refuse receivers in public places to encourage the public to both dispose of their refuse and to aid in the collection of recyclables for further processing.

At one time, the common public container for all kinds of waste materials was the ubiquitous heavy wire-mesh container. Such containers were fairly durable due to their heavy construction plus a certain degree of resiliency or bendability conferred by the open mesh wire construction. Such containers, however, have the disadvantage that the contents are exposed to public view and are frequently objectionable to many members of the public. In more recent years, various solid containers such as, in many cases, concrete containers and the like have been substituted for the former wire-mesh containers, although wire-mesh containers are still used, particularly where aesthetics is not a factor. While such concrete and the like containers are fairly durable and in many cases, particularly when they have an exterior surface of small decorative stones or the like, not unattractive, they are in many cases both difficult to empty and also expensive. Generally, solid containers made of thin coated metal or even durable plastic, including heavy plastic materials, are fairly economical and easy to handle, but objectionable to many people simply because they look like "garbage cans." They are also often subject to vandalism, since they can be easily picked up, knocked over and otherwise mishandled, in which case the metal tends to bend and flake off its coating, after which it becomes subject to corrosion. Plastic containers, in addition, can usually be fairly easily cracked or otherwise damaged when attacked by a determined vandal.

Within the last twenty years, a type of container having a decorative exterior composed originally of wood slats to give it a rustic appearance and more recently of plastic slats which look like wood or similar materials have come into use, particularly in upscale locations such as in shopping malls, public parks, the interior of large buildings and other places where it is desired to have a trash or recycling receptacle in plain sight, but the appearance of an ordinary trash receptacle or garbage container may be unacceptable. The provision of vertical wooden slats or artificial material slats having the appearance of wood over a cylindrical receptacle is particularly desirable because of the rustic appearance provided plus the ease of applying a vertical slat to the exterior of a cylindrical container, so long as the slat is maintained longitudinally aligned with the length of the cylinder. As indicated above, such receptacles have been in use for about two and a half decades and have been extremely popular for about a decade and a half. Such receptacles have been made in various ways including the attachment of the rustic slats on the outside of an ordinary trash can or barrel as well as the provision of a cylindrically shaped receptacle by the use of various internal supporting means such as structural rings and the like to reinforce the other slats so that the combination of the slats and the rings forms their own receptacle. If adequately reinforced internally, such slated exterior ring-reinforcing type containers have proved reasonably strong and durable.

Within the last several years a new type of container or receptacle having a slated exterior has come into use. This type of container or receptacle is provided with a slanted top rather than a flat top, resulting in a particularly attractive design. Furthermore, when such slatted receptacles are arranged around a central unifying post, a particularly attractive and aesthetically pleasing arrangement is provided. Such an arrangement is disclosed in U.S. Design Pat. 331,824 issued Dec. 15, 1992. The initial construction of the new slanted top slatted receptacles was effected by fastening slats with threaded fasteners to the exterior of an ordinary steel barrel with the fastenings passing into the external barrel hoops on such barrel. The internal steel barrel formed a strong construction for the container itself and the slatted exterior with attached differential length slats provided a pleasing appearance to the exterior. When a lid was desired, a flat lid was merely placed in the top supported by internal tabs spaced, usually at four locations, on the interior of the slats. The top could either be supported in a horizontal position or preferably was slanted to conform more or less with the top of the receptacle. Unfortunately, while the described arrangement provided a strong lower section for the receptacle, the upper slanted portion was left essentially unsupported, particularly with respect to the longer or higher slats and there was, furthermore, no satisfactory way to securely attach the top to the receptacle.

At this point, a new oval top ring was developed that allowed the exterior plastic slats to be directly attached either on the outside around the oval support ring or on the inside of such ring. A sturdy lid for the receptacle could then be directly attached to the top ring. Subsequently, a flat-topped version for the slatted plastic receptacle was developed in which the structural rings at the top of the receptacle and the bottom are provided with an inclination which allows the slats of the sides to be biased when pulled tight against the structural rings at the top and bottom to provide such slats with either an inward or outward bow which provides a visually pleasing curve to the side of the receptacle.

One disadvantage of these slatted type receptacles is that all the receptacles have the same general look either with flat tops or with slanted tops. The present inventor has now developed a more versatile top that not only provides a strong, durable and conveniently openable and securable lid but the option of providing a variety of easily replaceable top designs or treatments for various locations or times. These tops are also suppliable in various materials of construction. For example, in indoor less vandal-prone areas the tops may be formed from heavy molded plastic while in more exposed outdoor areas, the changeable top may be formed of damage resistant metal. The tops may furthermore easily be made with decorative treatments such as flared tops and the like around the exterior edges which do not interfere with removal of the contents of the receptacle because the decorative portions are removed with the top when such top is removed from the receptacle to remove the contents of the receptacle.

OBJECTS OF THE INVENTION

It is an object of the invention therefore to provide an arrangement at the top of a recycling or refuse container that facilitates the provision of a variety of tops.

It is a further object of the invention to provide a top treatment for a recycling and refuse container that provides for optional removable tops with various decorative treatments.

It is a still further object of the invention to provide a strong damage resistant receptacle resistant to the attempts of vandals to damage it as well as their efforts to remove recyclables or rubbish from it and strew such rubbish about.

It is a further object of the invention to provide a receptacle which may be easily and conveniently interchangeable with other similar receptacles with different top treatments.

It is a still further object of the invention to provide convertibility from one type of top to anther so the receptacle can be moved from one location to another conforming it to its new location by merely replacing the top.

It is a still further object of the invention to provide a strong damage resistant secure top or cover for a receptacle that may be easily removed and easily replaced either with the same lid or with a different configuration lid or cover.

It is a still further object of the invention to provide flexibility in design for the covers of trash and recycling receptacles by providing a convenient as well as strong and durable top design that can be replaced with other matching top designs.

Additional objects and advantages of the invention will become evident from review of the following description in connection with the appended drawings.

BRIEF DESCRIPTION OF THE INVENTION

This invention is directed to a slatted-type trash and recycling receptacle wherein the plastic slats are secured to metal structural rings, the assembled slats and structural ring providing a strong damage resistant receptacle and in which the top ring is provided with an upwardly extending circular neck preferably inwardly oriented with respect to the slats, such neck being provided internally or externally with detents including threads adapted to be interconnected with matching detents on a top or lid which is adapted thereby to be easily connected to the upper structural ring while easily removed. The lid or cover is adapted to be formed in several embodiments including being supplied with flared outwardly and upwardly extending decorative edges, straight decorative edges and smooth edges forming a domed top. One or more restricted sized orifices are provided in the top or lid for the receipt of trash or recyclables, each orifice being restricted in size to discourage reaching into the orifice to access the contents of the receptacle.

BRIEF DESCRIPTION OF THE DRAWINGS

FIGS. 11, 12 and 13 show partial sections of the top, middle and lower or bottom structural rings with slats partially applied to illustrate the construction of the entire assembly.

FIG. 14 is an isometric view of the bottom of one of the lids or covers of the invention showing the partially threaded neck adapted for connection with the neck of the upper structural ring.

DESCRIPTION OF THE PREFERRED EMBODIMENTS

The following detailed description is of the best mode or modes of the invention presently contemplated. Such description is not intended to be understood in a limiting manner and is presented solely for illustration thereof, and by reference to which in connection with the following description and the accompanying drawings one skilled in the art may be advised of the advantages and construction of the invention.

In accordance with the present invention there is provided a plastic slatted refuse and recycling receptacle in which the receptacle has not only a top that can be removed in order to easily remove refuse and recyclables deposited within, but which top can be replaced by several different tops which provide the receptacle as a whole with substantially different looks or appearances overall. A regular series of such tops range from extremely plain to a relatively ornate flared cornice-type treatment can be provided. Thus, a single basic receptacle can be provided with several different standard looks merely with a change of the top. Ultimately a wide variety of special or custom treatments are possible. Change of the top and thereby the looks of the receptacle are attained by merely removing the top as is also done to remove rubbish or recyclables, and replacing the top with a different design top made to be applied to the same base. Thus, changing the appearance of the receptacle is accomplished in the same manner as removing the top to remove material deposited within such receptacle.

Figure 1:
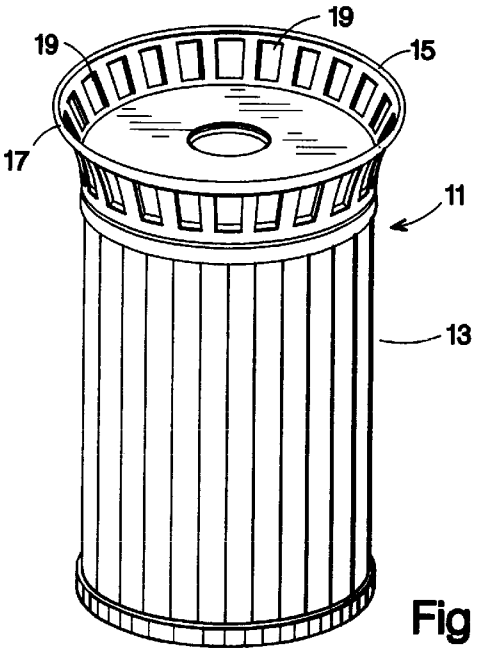
FIG. 1 is an isometric view of one embodiment of the slatted receptacle top assembly of the invention in which the top has a flared pierced decorative edge.
Figure 1A:
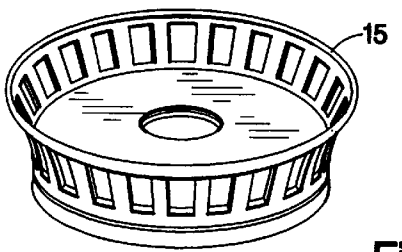

In FIG. 1 there is shown an isometric view of a plastic slatted refuse and recyclable receptacle 11 having a standard lower section 13 and a replaceable top section 15. It will be noted that the top section shown in FIG. 1 has a flared cornice-type treatment around the upper edge, which provides the top and the entire receptacle with a unique or distinctive appearance. The cornice construction 17 is in the form of an outwardly flared molded edge having a series of openings 19 of modified rectangular shape in it. The appearance of the cornice can be readily changed by changing the shape of the openings. The top 15 of the receptacle is shown by itself in FIG. 1A.

Figure 2:
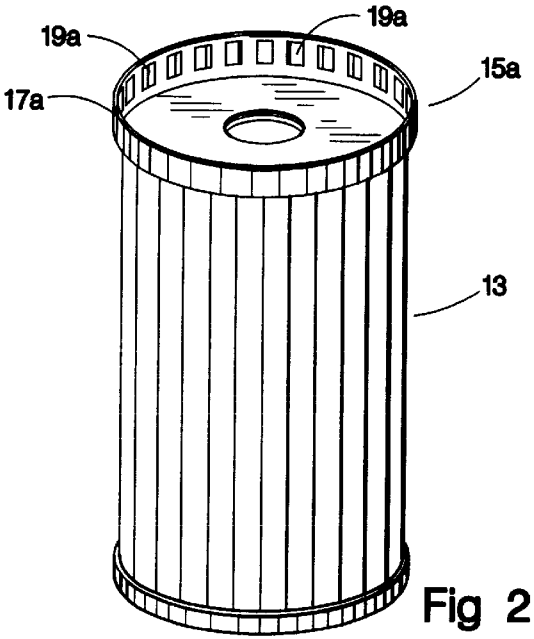
FIG. 2 is an isometric view of a further embodiment of the invention with a somewhat different design on top comprising an upwardly extending pierced ring formation about the edge.

FIG. 2 is an isometric view of a further embodiment of the invention with essentially a different top 15*a* having a different lower unflared cornice 17*a* around the top edge of the receptacle top. It will be noted that the decorative orifices 19*a* in the cornice 17*a* are more square than the more rectangular slightly tapered orifice 19 in the cornice 17 of the first embodiment shown in FIGS. 1 and 1A.

Figure 3:
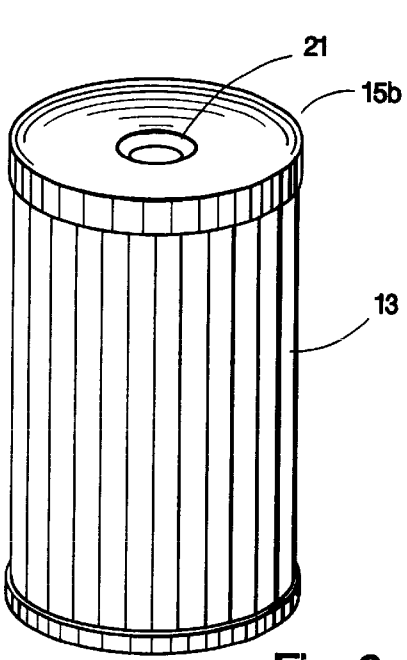
FIG. 3 is an isometric view of a still further embodiment of the invention with a smooth top without decorative treatment suitable for less opulent surroundings and also providing less means for vandals to grip the top and try to remove it or the entire assembly.

FIG. 3 is an isometric view of a still further embodiment of the convertible receptacle shown in the previous Figures. It will be noted that the top 15B has an unadorned treatment without any cornice effect at all, merely showing a slightly domed upper surface with a central restricted diameter orifice 21 in it.

Figure 4:
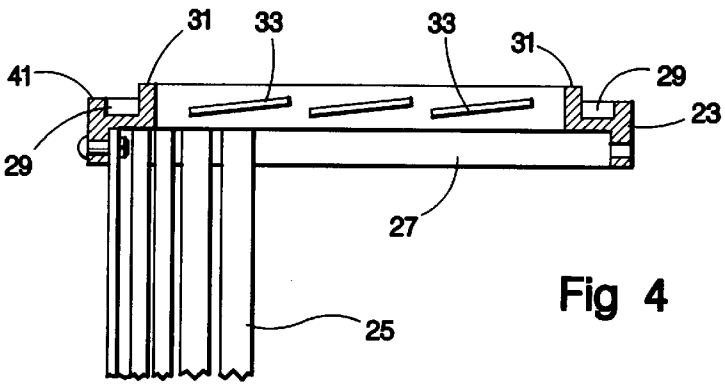
FIG. 4 is a partially broken away sectional view of the top structural ring of the receptacle showing the partially threaded upwardly extending neck for receipt of the top of the receptacle assembly.

FIG. 4 is a partially broken away sectional view of the construction of the upper portion of the standard lower receptacle section 13 in accordance with the present invention showing the structural ring 23 with slats 25 attached to such structural ring 23 along a lower flange 27 and with a horizontal flange 29 extending inwardly with an upwardly extending circular neck 31 supported from the inwardly extending flange 29. The neck 31 is provided with a series of detents 33 in the form of short threads adapted to receive matching detents 35 on a similar downwardly extending matching neck 37 upon the top or cover 15, 15*a* or 15*b*. See FIG. 5 which is a partially broken away view of the cover of the assembly 11 shown in FIG. 1. As can be seen, the cover or top 15 can be mounted upon the receptacle section 13 by inserting the neck 37 of the top within the neck 31 of the upper structural ring and twisting the top approximately one quarter turn to secure the two together. It will be evident from FIG. 4 that other locations for the neck 31 and detents may be arranged including use of the outer flange 41. It is desirable to provide flange 41, however, as a stop against which the outer flange 43 of the top 15 may abut. See FIG. 5.

Figure 5:
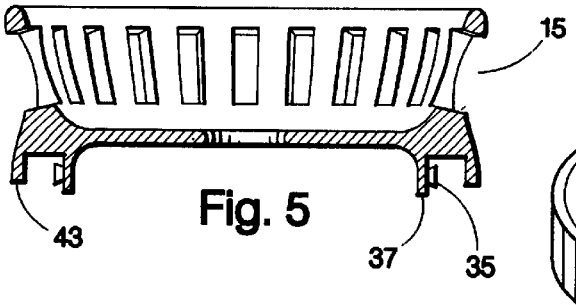
FIG. 5 is a cross-sectional view of the top or cover of the assembly shown in FIG. 1 showing the neck that extends downwardly and releasably secures with the upwardly extending neck of the upper structural ring.
Figure 6:
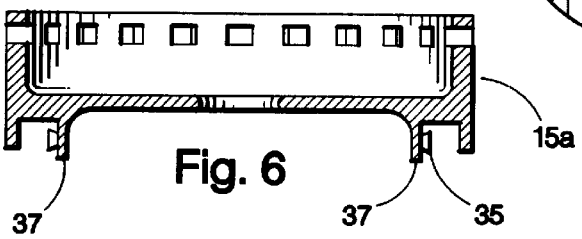
FIG. 6 is a cross-sectional view of the top or cover of the assembly shown in FIG. 2 in the manner shown in FIG. 5.

FIG. 6 is a cross sectional view of the top 15*b* of the assembly shown in FIG. 2 in a similar manner to that shown in FIG. 5.

Figure 7:
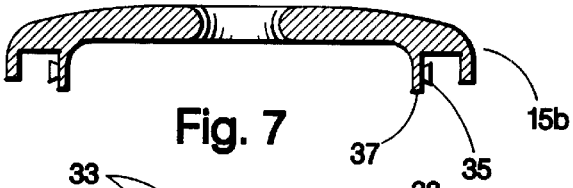
FIG. 7 is a cross-sectional view of the top or cover of the assembly shown in FIG. 3 in the manner shown in FIGS. 5 and 6.

FIG. 7 is a cross sectional view of the top shown in FIG. 3 in a similar manner to that shown in FIGS. 5 and 6.

Figure 8:
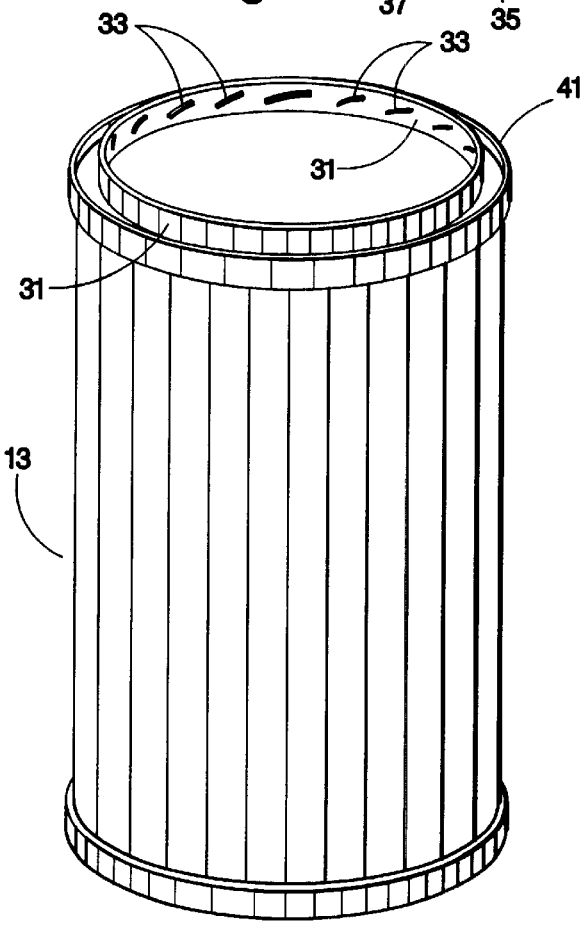
FIG. 8 is an isometric view of the receptacle of the invention with the lid or cover removed.

FIG. 8 is an isometric view of the lower section 13 of the plastic slatted receptacle assembly shown in FIGS. 1, 2, and 3.

Figure 9:
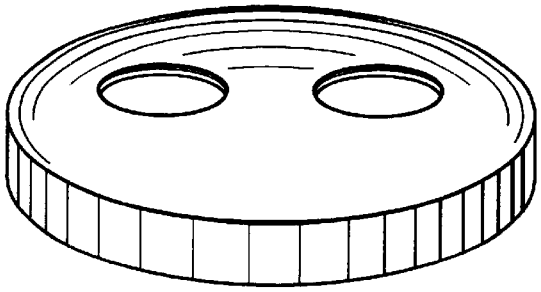
FIG. 9 is an isometric top view of a cover in accordance with the invention having two orifices in its surface.

FIG. 9 is an isometric upper view of a cover in accordance with the invention having two orifices in the cover surface.

Figure 10:
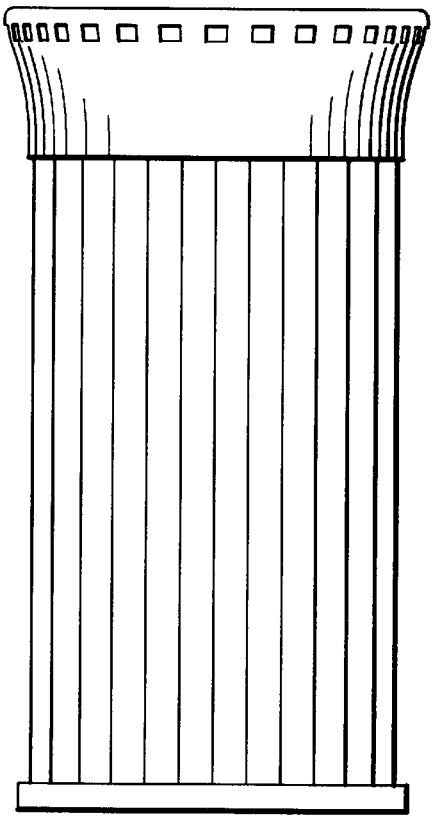
FIG. 10 is a side view of the recycling and refuse container shown isometrically in FIG. 1, but with smaller openings or orifices in the interchangeable top.

FIG. 10 is a side view of the recycling and refuse container shown isometrically in FIG. 1, but with smaller openings or orifices in the interchangeable top.

FIGS. 11, 12, and 13 show partial sections of the top middle and lower or bottom structural rings supporting the slats of the bottom section 13 of the receptacle body 13.

FIG. 14 is an isometric view of the bottom of one of the covers or tops 15 of the invention showing the partially threaded neck 37 adapted for connection with or to the corresponding neck 31 of the upper structural ring.

It will be recognized that the various Figures together show a representation of an improved recycling and refuse receptacle that is not only efficient in collection of trash and recyclables, but which also can be changed easily and quickly from one embodiment or appearance to another by merely substituting different design tops in the same way that the top or tops are removed for the removal of refuse or recyclables from the interior of the receptacle and then replaced after removal of such waste materials. Both standard and replaceable or changeable heads or tops 15 of the receptacle 13 can be carried by a producer. Custom made heads can also be easily made. The heads or tops 15 can be secured to the standard lower section 13 by any suitable lock to deter unauthorized removal or change of the tops.

While the present invention has been described at some length and with some particularity with respect to the several described embodiments, it is not intended that it should be limited as to any particulars or embodiments or any particular embodiment, and is to be construed with reference to the appended claims so as to provide the broadest possible interpretation of such claims in view of the prior art and, therefore, to effectively encompass the intended scope of the invention.

What is claimed is:

1. A slatted refuse and recycling receptacle adapted for use with a set of replaceable receptacle tops adapted to be easily interchanged with other tops having a variety of configurations to provide a receptacle-top combination having a variable upper configuration comprising:

(a) a slatted recycling and refuse receptacle comprised of:
  (i) an upper structural ring incorporating a substantially vertically oriented transversely circumferential surface adapted for connection with elongated vertically oriented, plastic slats,
  (ii) a lower structural ring having a substantially vertically oriented transversely circumferential surface adapted for connection with the vertically oriented plastic slats,
  (iii) the upper structural ring having a further transversely circumferential member incorporating a surface provided with a series of detents extending therefrom to accommodate interengagement with a series of detents upon the side of a vertically extending flange of a top closure member (b) a top closure member selected from a plurality of closure members adapted for extension substantially across the entire top of the receptacle, each top closure members being comprised of:
  (i) a top closure section adapted for intersection with and formation of a top closure for the receptacle extending substantially across the entire top of the receptacle,
  (ii) a circumferential dependent flange section adapted to extend downwardly from the top closure section and having a diameter such as to bring it when mounted upon the slatted receptacle close to the upper structural ring surface, said section having a series of detents interengagable with the detents on the transverse circumferential surface of the upper structural ring,
  (iii) at least one restricted diameter orifice in the top closure section for the insertion of refuse and recyclable materials into the slatted receptacle.

2. A slatted refuse and recycling receptacle in accordance with claim 1 wherein the outer surface of the top closure member is provided with an upwardly and outwardly extending circumferential cornice type decorative edge section on the cover, the decorative edge section being not only decorative, but also useful for manual removal of the top closure section from the receptacle.

3. A slatted refuse and recycling receptacle in accordance with claim 1 wherein the outer surface of the top closure member is provided with an upwardly extending circumferential cornice type decorative edge effect on the cover.

4. A slatted refuse and recycling receptacle in accordance with claim 1 wherein the outer surface of the closure member is provided with a pleasing curved configuration.

5. A slatted refuse and recycling receptacle in accordance with any of claims 1, 2, 3 or 4 wherein the upper structural ring of the slatted receptacle is provided with a circumferential upwardly extending flange surrounding the transversely circumferential member provided with interengaging detents providing a groove circumferentially about the upper portion of the upper structural ring adapted to receive an outer circumferential flange dependent from the top closure member when the top closure member detents are engaged with the slatted receptacle detents.

6. A slatted recycling and trash receptacle in accordance with claim 1 wherein the top of the receptacle is designed with a decoration treatment around such top plus provision to remove substantially the entire top covering and replace it with a rotatively securable cover having an alternative configuration.

7. A slatted recycling and trash receptacle in accordance with claim 6 wherein the decorative treatment provided around the surface of the top is a cornice effect which is removed from the receptacle along with the structural portions of the top.

* * * * *